US009966719B1

(12) United States Patent
Ang et al.

(10) Patent No.: US 9,966,719 B1
(45) Date of Patent: May 8, 2018

(54) CONNECTOR MODULE HAVING INSULATED METAL FRAME

(71) Applicant: INTERNATIONAL BUSINESS MACHINES CORPORATION, Armonk, NY (US)

(72) Inventors: Ai K. Ang, Anchorvale Link (SG); Matthew S. Kelly, Oakville (CA); Curtis T. Grosskopf, Hyde Park, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days. days.

(21) Appl. No.: 15/843,771

(22) Filed: Dec. 15, 2017

Related U.S. Application Data

(63) Continuation of application No. 15/660,101, filed on Jul. 26, 2017.

(51) Int. Cl.
*B22D 19/10* (2006.01)
*H01R 43/18* (2006.01)
(Continued)

(52) U.S. Cl.
CPC ..... *H01R 43/18* (2013.01); *H01R 12/707* (2013.01); *H01R 12/716* (2013.01);
(Continued)

(58) Field of Classification Search
CPC H01R 13/641; H01R 13/465; H01R 13/7175; H01R 23/025; H01R 4/72; H01R 23/688
(Continued)

(56) References Cited

U.S. PATENT DOCUMENTS 5,509,823 A * 4/1996 Harting ..... H01R 12/57 439/607.17
6,390,851 B1 * 5/2002 Belopolsky ..... H01R 13/6464 439/607.38
(Continued)

FOREIGN PATENT DOCUMENTS

WO 2013019414 A1 2/2013

OTHER PUBLICATIONS

Contributed Article, "How to Specify Electrical Insulating Material", connectorsupplier.com, © 2017 Connector and Cable Assembly Supplier, All Rights Reserved, May 4, 2015, printed Feb. 23, 2017, pp. 1-12.
(Continued)

*Primary Examiner* — Phuong Chi T Nguyen
(74) *Attorney, Agent, or Firm* — Michael O'Keefe

(57) ABSTRACT

A method for electrically insulating a connector module mounted on a printed circuit board assembly, the method including coating a first portion of a piece of sheet metal with an insulation material, forming the piece of sheet metal into a metal frame, wherein a second portion of the piece of sheet metal not coated with the insulation material is formed into a grounding pin, assembling the connector module, wherein components of the connector module include the metal frame, a housing, and a set of external pins, and mounting the connector module on a printed circuit board to form a printed circuit board assembly, wherein the set of external pins are electrically connected to a corresponding set of vias on the printed circuit board, and the grounding pin is electrically connected to a ground on the printed circuit board.

1 Claim, 9 Drawing Sheets

(51) Int. Cl.

| | |
|---|---|
| ***H01R 13/518*** | (2006.01) |
| ***H01R 12/71*** | (2011.01) |
| ***H01R 12/70*** | (2011.01) |
| ***H01R 43/20*** | (2006.01) |
| ***H01R 13/6581*** | (2011.01) |
| *H01R 13/10* | (2006.01) |

(52) U.S. Cl.
CPC ..... *H01R 13/518* (2013.01); *H01R 13/6581* (2013.01); *H01R 43/205* (2013.01); *H01R 13/10* (2013.01)

(58) Field of Classification Search
USPC ..... 439/489, 488, 490, 535, 536, 523, 108
See application file for complete search history.

(56) References Cited

U.S. PATENT DOCUMENTS

| | | | | |
|---|---|---|---|---|
| 6,619,986 | B1 | 9/2003 | Yeh | |
| 7,364,458 | B1 * | 4/2008 | Ju ..... | H01R 13/2414 439/524 |
| 7,682,194 | B2 | 3/2010 | Lin et al. | |
| 7,749,000 | B1 * | 7/2010 | Lai ..... | H01R 13/64 439/83 |
| 8,233,284 | B2 | 7/2012 | Ju et al. | |
| 8,764,493 | B2 | 7/2014 | Renteria et al. | |
| 9,089,065 | B2 | 7/2015 | Zhang | |
| 9,277,664 | B2 * | 3/2016 | Yoshino ..... | H04R 1/00 |
| 2013/0288526 | A1 | 10/2013 | Rascon et al. | |
| 2014/0140900 | A1 | 5/2014 | Braunreiter et al. | |
| 2014/0292196 | A1 | 10/2014 | Chou | |
| 2014/0377996 | A1 | 12/2014 | Renteria et al. | |
| 2015/0132990 | A1 | 5/2015 | Nong Chou et al. | |
| 2016/0087378 | A1 | 3/2016 | Chen et al. | |

OTHER PUBLICATIONS

Ang et al., "Connector Module Having Insulated Metal Frame", U.S. Appl. No. 15/660,101, filed Jul. 26, 2017, pp. 1-33.
Ang et al., "Connector Module Having Insulated Metal Frame", U.S. Appl. No. 15/818,157, filed Nov. 20, 2017, pp. 1-31.
IBM: List of IBM Patents or Patent Applications Treated As Related (Appendix P), Jan. 24, 2018, pp. 1-2.

* cited by examiner

CONNECTOR MODULE HAVING INSULATED METAL FRAME

BACKGROUND

The present invention relates, generally, to the field of electronic devices, and more particularly to housing assemblies of electronic devices.

A connector module is an assembly containing electronic circuitry and electronic devices and is mounted on a printed circuit board (hereinafter "PCB"), forming a printed circuit board assembly (hereinafter "PCBA"). The connector module typically has a metal frame and one or more port connections for external connections, for example an Ethernet connection. PCB design rules require a standoff clearance between the connector module and the PCB to avoid unintentional electrical contact between devices on the PCB and the connector module.

When the standoff clearance is not maintained, the metal frame of the connector module may come in contact with an exposed metal line or via on the PCB. Further, incorrect or improper mounting of the connector module, or movement of the connector module after initial mounting may result in electrical contact between the connector module and with the PCB. Such unintentional electrical contact can affect functionality and may cause failure of the PCBA.

SUMMARY

According to an embodiment, a method for electrically insulating a connector module mounted on a printed circuit board assembly is provided. The method including coating a first portion of a piece of sheet metal with an insulation material, forming the piece of sheet metal into a metal frame, wherein a second portion of the piece of sheet metal not coated with the insulation material is formed into a grounding pin of the metal frame, assembling the connector module, wherein components of the connector module comprise the metal frame, a housing, and a set of external pins, and mounting the connector module on a printed circuit board to form a printed circuit board assembly, wherein the set of external pins are electrically connected to a corresponding set of vias on the printed circuit board, and the grounding pin is electrically connected to a ground on the printed circuit board, and a space remains between the connector module and the printed circuit board.

According to an embodiment, a method for electrically insulating a connector module mounted on a printed circuit board, the method including forming a piece of sheet metal into a metal frame, dip coating a first portion of the piece of sheet metal with an insulation material while simultaneously not dip coating a second portion of the piece of sheet metal with the insulation material, wherein the second portion includes a grounding pin, assembling the connector module, wherein components of the connector module include the metal frame, a housing, a socket, a set of wires, electronic devices, and a set of external pins, and mounting the connector module on the printed circuit board, wherein the set of external pins are electrically connected to electronic circuitry on the printed circuit board.

According to an embodiment, an electrically insulated connector module is provided. The electrically insulated connector module including a socket, wherein the socket accepts a connector, a plastic housing supporting the socket, a set of external pins providing a set of electrical connections from a printed circuit board within the plastic housing, a metal frame surrounding the plastic housing, the socket, and one end of the set of external pins, and an insulated jacket, the insulated jacket adhering to a bottom of the electrically insulated connector module, a lower portion of a front of the electrically insulated connector module, a lower portion of a first side of the electrically insulated connector module, a lower portion of a second side of the electrically insulated connector module, and a lower portion of a back of the electrically insulated connector module, wherein the insulated jacket includes a first opening corresponding to a grounding pin of the metal frame, and a second set of openings corresponding to the set of external pins.

BRIEF DESCRIPTION OF THE DRAWINGS

These and other objects, features and advantages of the present invention will become apparent from the following detailed description of illustrative embodiments thereof, which is to be read in connection with the accompanying drawings. The various features of the drawings are not to scale as the illustrations are for clarity in facilitating one skilled in the art in understanding the invention in conjunction with the detailed description. In the drawings.

DETAILED DESCRIPTION

Figure 1:
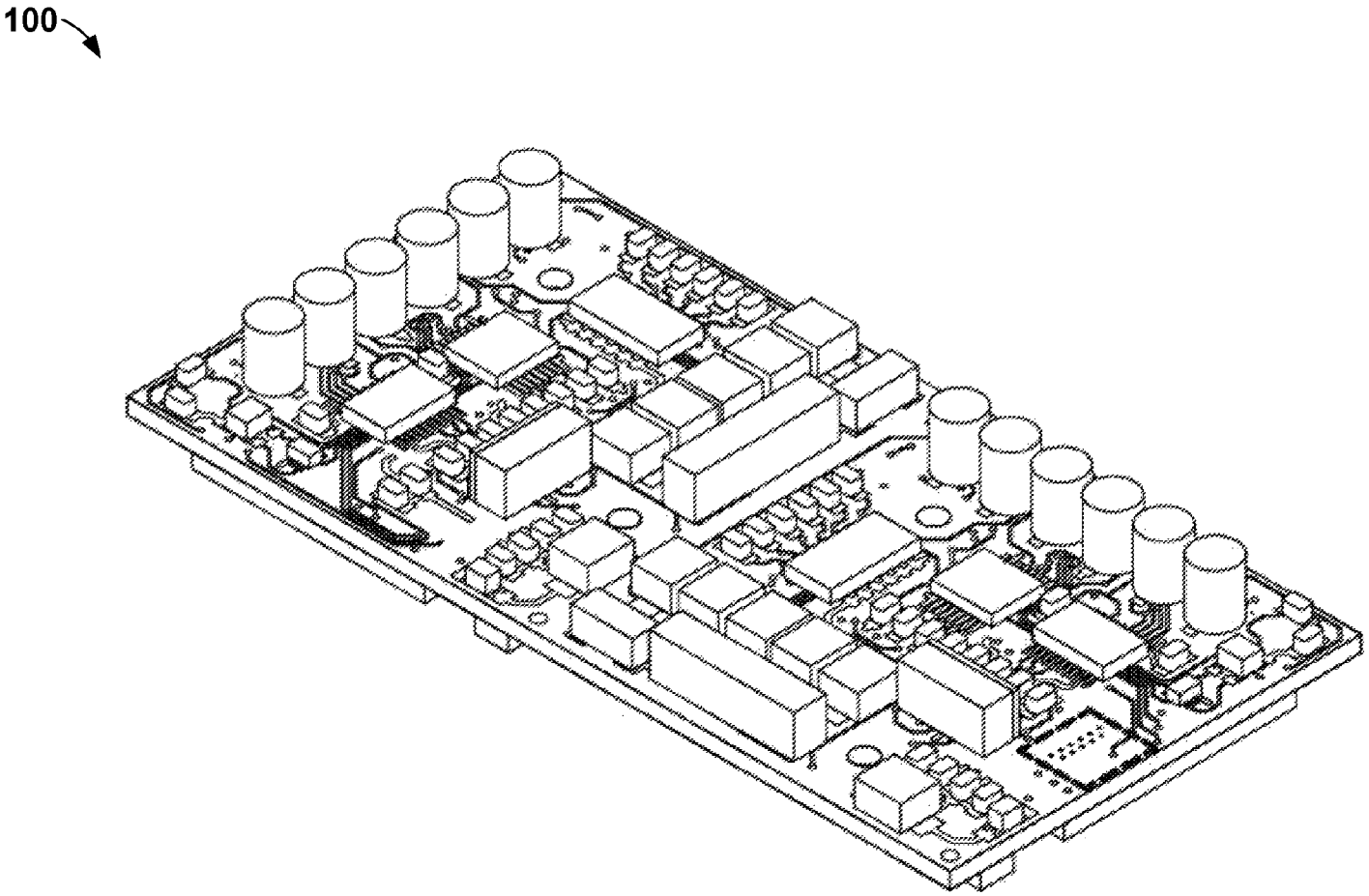
FIG. 1 illustrates an isometric view of a printed circuit board assembly (hereinafter "PCBA"), according to an embodiment.

Detailed embodiments of the claimed structures and methods are disclosed herein; however, it can be understood that the disclosed embodiments are merely illustrative of the claimed structures and methods that may be embodied in various forms. This invention may, however, be embodied in many different forms and should not be construed as limited to the exemplary embodiments set forth herein. In the description, details of well-known features and techniques may be omitted to avoid unnecessarily obscuring the presented embodiments.

Embodiments of the present invention relate to the field of electronic devices, and more particularly to assembling and mounting assemblies of electronic devices which may be electrically conductive. The following described exemplary embodiments provide a method, and a structure to, among other things, prevent a short circuit between a connector module and a printed circuit board (hereinafter "PCB") upon which it is mounted. Therefore, the present embodiment has the capacity to improve the technical field of assembling and mounting assemblies of electronic devices by an addition of an insulation material with good adhesion to metal and plastic which creates an isolation layer between the connector module and the PCB.

As previously described, a connector module is an assembly containing electronic circuitry and electronic devices which may be mounted on a PCB. The connector module typically has a metal frame and one or more port connections. For example, the port connections may be used for Ethernet networking applications with an RJ45 socket. The connector module contains electronic circuitry and electronic devices. Printed Circuit Board Assembly (hereinafter "PCBA") design rules require a standoff clearance between the connector module and the PCB to avoid unintentional electrical contact between the connector module and vias and other metal features on the PCB under or near the connector module.

Typically a design of the PCBA is intended to avoid any line or trace, electronic devices and vias on the PCB in a footprint for placement of the connector module. However, due to space constraints on the PCBA, it is common to have a wire, electronic device, or via placed in the footprint. Additionally, due to part to part variability, improper mechanical placement of the connector module, soldering, and other activities occurring to and around the PCB, the metal frame of the connector module may come in contact with a line, an electronic device, or via on the PCBA. This can cause a short circuit between the line, electronic device, or via on the PCBA and the connector module, which can lead to product failure. As such, it may be advantageous to, among other things, electrically isolate the connector module from the PCBA. Specifically, the connector module may be covered with an insulation material. The insulation material may have good adhesion to both metal and plastic. Covering the connector module with the insulation material may help prevent a short circuit when a standoff clearance is not maintained between the PCB and the connector module, and the metal frame of the connector module is in contact the PCB.

According to an embodiment, a barrier of insulation material on the metal frame surrounding the connector module may help to prevent electrical shorts and subsequent failure of the PCB and the PCBA.

A potential problem occurring after assembly of PCBs and assembly of connector modules are metal whiskers. Metal whiskers may form and grow in plated finishes that are in a high stress state. Tin and zinc finishes have been known to be susceptible to whisker formation and both are commonly used in electronic assemblies. Metal whiskers are small diameter metal "hairs" that are electrically conductive. Metal whiskers may cause short circuits between electronic devices, lines, and vias on the PCBA and the connector module.

According to an embodiment, a barrier of insulation material on the connector module may help to prevent metal whiskers from causing a short circuit between electronic devices, wiring, and vias on the PCBA and the connector module.

Referring now to FIG. 1, a printed circuit board assembly (hereinafter "PCBA") 100 is shown, according to an embodiment. The PCBA 100 includes a printed circuit board and may have electronic devices, such as integrated circuits, mounted to its surface. The integrated circuits may include a connector module, a microprocessor, a memory device, a capacitor, an insulator, and other devices.

Figure 2:
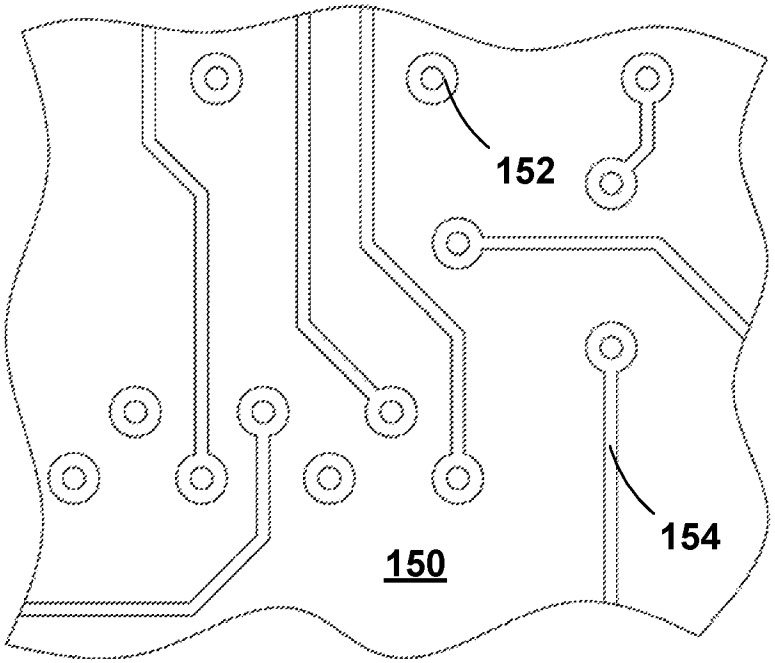
FIG. 2 illustrates a top view of a printed circuit board (hereinafter "PCB"), according to an embodiment.

Referring now to FIG. 2, a top view of a section of a printed circuit board (hereinafter "PCB") 150 is shown, according to an embodiment. The PCB 150 includes an electronic circuit which has wiring or lines and vias of conductive material etched from a layer of conductive material affixed to an insulated sheet, for example a via 152 and a line 154. The via 152 may comprise two electrically conductive pads in a line, for example, the line 154, of the PCB 150, where the two electrically conductive pads have corresponding positions on different layers of the PCB 150, and the two electrically conductive pads are electrically connected by a hole through the board. The via 152 may electrically connect a line or an electronic device of a bottom of the PCB 150 with wiring or an electronic device of a top of the PCB 150. Alternatively, the via 152 may be electrically connected to an inner layer of the PCB 150.

Figure 3:
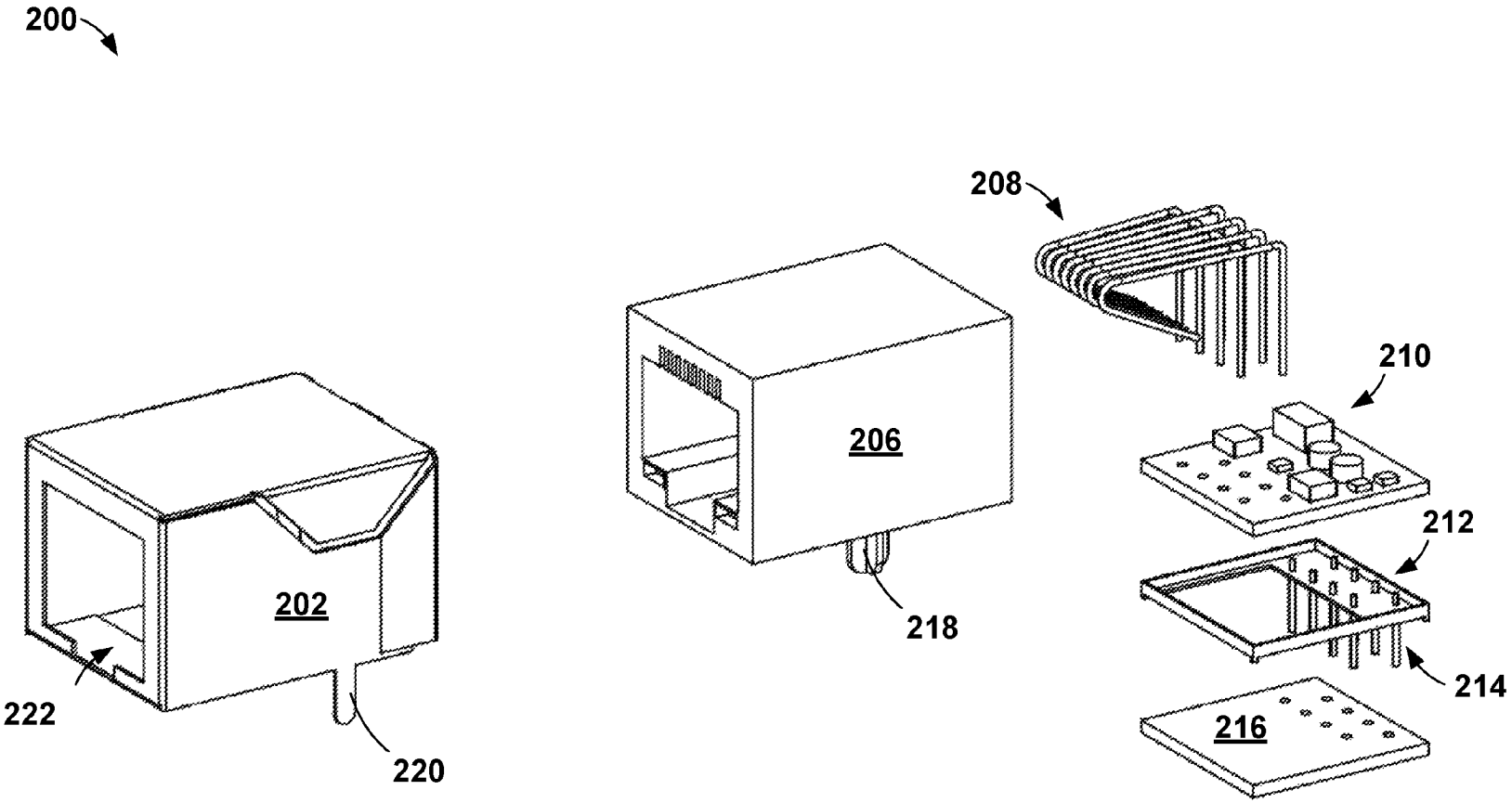
FIG. 3 illustrates an exploded isometric view of a connector module, according to an embodiment.

Referring now to FIG. 3, an exploded isometric view of a connector module 200 is shown, according to an embodiment. The connector module 200 may include a metal frame 202, a housing 206, a set of connector wires 208, a first internal printed circuit board assembly (hereinafter "PCBA") 210, a wire structure 212, and a second internal printed circuit board (hereinafter "PCB") 216.

The metal frame 202 may be fabricated from sheet metal, such as aluminum, steel, or iron, and may have a ferrite coating. The metal frame 202 may perform a function as a Faraday cage or shield to block electromagnetic fields to and from the connector module 200. The metal frame 202 may encompass components of the connector module 200, including the housing 206, the set of connector wires 208, the first internal PCBA 210, the wire structure 212, and the second internal PCB 216. The metal frame 202 may include a grounding pin 220. The grounding pin 220 may be used to connect an electrical ground of the connector module 200 to an electrical ground on an eternal PCB, for example, the PCB 150, during mounting. The PCB 150 may have a corresponding feature designed to electrically connect the grounding pin 220 to electrical ground of the PCB 150. There may be one or more grounding pins 220.

The housing 206 may be made of a plastic material and may include a locator pin 218. The locator pin 218 may be used to locate the connector module 200 on the PCB 150 during mounting. The locator pin 218 may provide mechanical support of the connector module 200 when mounted on the PCB 150. The PCB 150 may have a corresponding feature which helps to align the connector module 200 onto the PCB 150. The locator pin 218 may help maintain integrity of a space between the connector module 200 and the PCB 150. There may be one or more locator pins 218.

The set of connector wires 208 may have one or more wires. The first internal PCBA 210 may include mounted electronic devices, such isolation circuitry, a magnetic coil, and a light emitting diode, providing functionality to the connector module 200. The set of connector wires 208 may be electrically connected to the first internal PCBA 210. The wire structure 212 may include a mounting for the first internal PCBA 210 and include a set of metal pins 214. The set of metal pins 214 may extend externally from the connector module 200, and may be used to electrically connect the mounted electronic devices on the first internal PCBA 210 to an external PCB, for example the PCB 150, upon which the connector module 200 may be mounted. The second internal PCB 216 may be a portion of a bottom surface of the connector module 200, and provide additional structural support for the connector module 200. A bottom portion of the housing 206 may be a portion of a bottom of the connector module 200. Alternatively, a bottom of the housing 206 may be enclosed by the metal frame 202.

In an embodiment, the metal frame 202 may cover a bottom of the connector module 200. In an alternate embodiment, the metal frame 202 of the connector module 200 may overlap a portion of the bottom of the connector module 200, and have a folded edge over a portion of one or more edges of the bottom of the connector module 200. A portion of the housing 206 may cover a portion of the bottom of the connector module 200. A portion of a bottom of the second internal PCB 216 may cover a portion of the bottom of the connector module 200.

The connector module 200 may contain more or less components as illustrated in FIG. 3. The connector module 200 may form a socket with an opening 222 which accepts a connector. The set of connector wires 208 may have wires which bend into a shape that may compress when the connector is inserted into the connector module 200. The connector module 200 may have wires that correspondingly may be electrically connected to the set of connector wires 208. As an example, the connector module 200 may have multiple openings 222, each of which contain a set of connector wires 208, allowing multiple connectors to connect to the connector module 200. In an embodiment, the connector module 200 may accept an inserted Ethernet connector. Ethernet is a network protocol which controls how data is transmitted.

Figure 4:
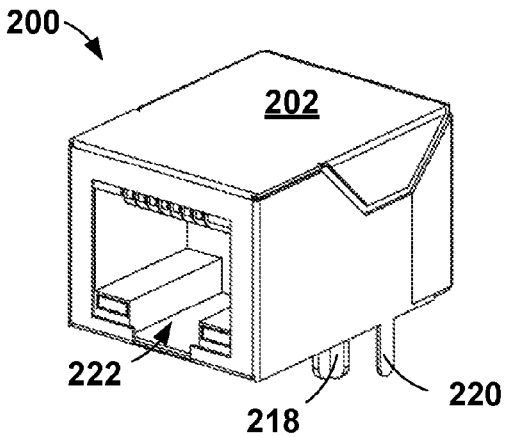
FIGS. 4, and 5, each illustrate an isometric view of a single port connector module, according to an embodiment.
Figure 5:
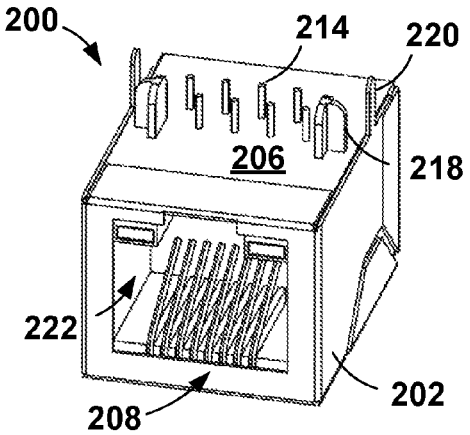
Figure 6:
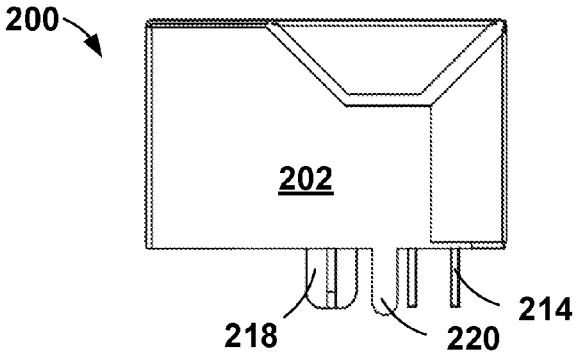
FIG. 6 illustrates a side view of a single port connector module, according to an embodiment.

Referring now to FIGS. 4, 5, and 6, each of FIGS. 4 and 5 illustrate an isometric view of the connector module 200, as described above, according to an embodiment. Referring to FIG. 6, a side view of the connector module 200 is shown, as described above, according to an embodiment.

As shown in FIG. 4, the isometric view of the connector module 200 illustrates a front, a top and a first side of the connector module 200. As shown in FIG. 5, the isometric view of the single port connector module illustrates the front, a bottom and a second side of the connector module 200.

The connector module 200, as shown in FIGS. 4-6, includes an opening 222, a grounding pin 220, a locator pin 218, a set of metal pins 214, a set of connector wires 208, a metal frame 202, and a housing 206, all as described above. The opening 222 may accept a connector, for example an Ethernet connector, as described above. The grounding pin 220 may be part of the metal frame 202, and function as described above. The locator pin 218 may be part of the housing 206, as described above. The set of metal pins 214 may be used to electrically connect the connector module 200 to a PCB, for example the PCB 150, upon which the connector module 200 is mounted. The set of connector wires 208 may electrically connect the connector module 200 to a connector inserted into the opening 222. In FIG. 5, two locator pins 218 and two grounding pins 220 are illustrated. In this embodiment, the metal frame 202 overlaps a portion of a bottom of the connector module 200. In an alternate embodiment, the metal frame 202 may cover the bottom of the connector module 200.

Figure 7:
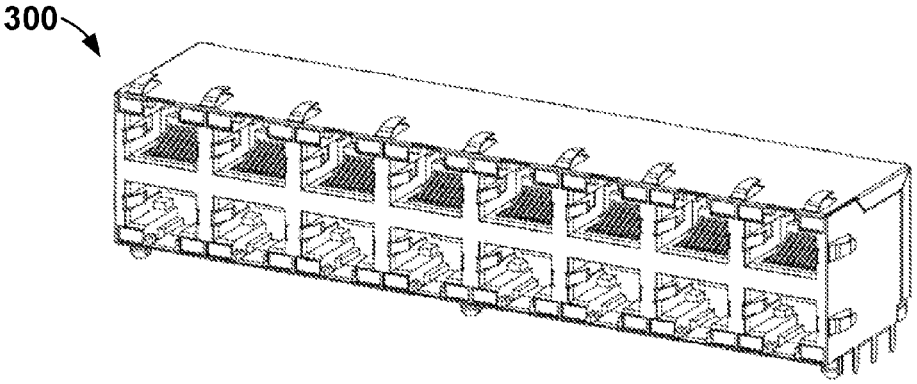
FIG. 7 illustrates an isometric view of a 16 port connector module, according to an embodiment.

Referring now to FIG. 7, an isometric view of a 16 port connector module 300 is shown, according to an embodiment. The 16 port connector module 300 is an example of a connector module with two rows of 8 ports. Each port includes an opening which may accept a connector, for example an Ethernet connector. The 16 port connector module 300 may function similarly as the connector module 200, as described above, with 15 additional ports. The 16 port connector module 300 may have a larger footprint on a corresponding PCB, upon which it is mounted. This may result in a higher likelihood of an electronic device, line, or via, within the footprint, and may have a higher likelihood of an error occurring due to an inadvertent electrical short between 16 port connector module 300 and the PCB.

Figure 8:
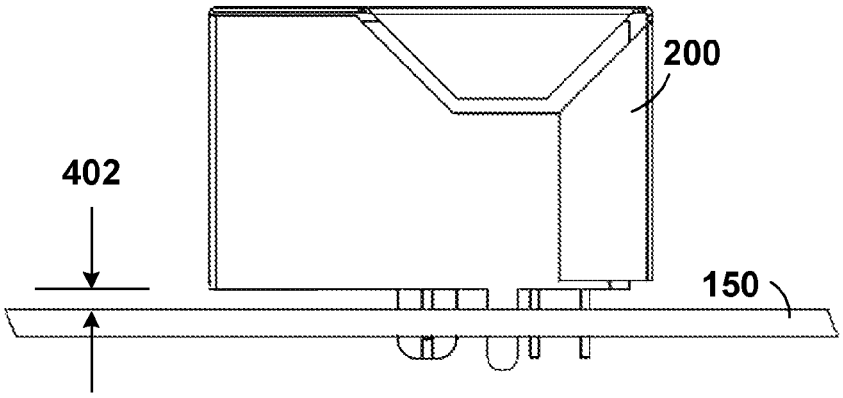
FIGS. 8, 9, and 10, each illustrate a side view of an connector module mounted on a PCB, according to an embodiment.
Figure 9:
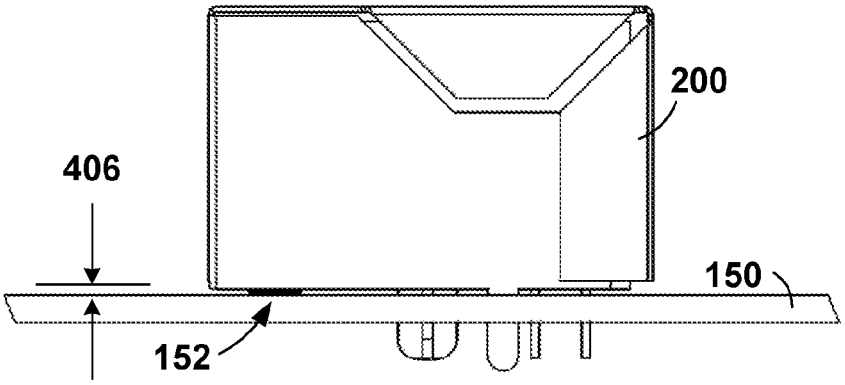
Figure 10:
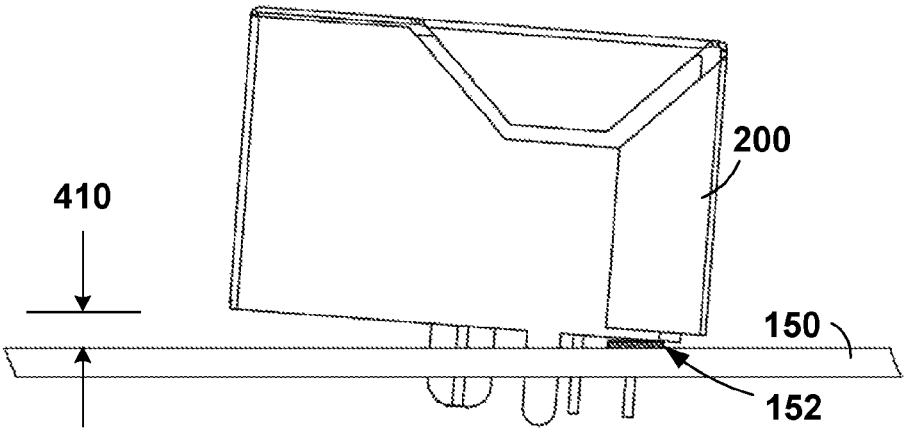

Referring now to FIGS. 8, 9, and 10, each figure illustrates a side view of the connector module 200 mounted on the PCB 150, according to an embodiment. The connector module 200 is described above in greater detail with respect to FIGS. 3-6. As shown in FIG. 8, the connector module 200 is mounted with a space 402, or a standoff, between the connector module 200 and the PCB 150. In this example, the space 402 meets a required standoff clearance between the connector module and the PCB 150. Integrity of the space 402 between the connector module 200 and the PCB 150 should be maintained in order to avoid unintended electrical contact between the connector module 200 and the PCB 150.

An initial design of the PCB 150 may designate a keep-out area on the PCB 150 for placement of the connector module 200. As designed, no wiring, vias, nor other electronic devices would be located within the keep-out area. Maintaining of the keep-out area in the PCB 150 design helps to reduce a chance of an electrical short circuit between the connector module 200 and circuitry of the PCB 150. However, as the size of the PCB 150 shrinks, and the density of wires on the PCB 150 increases, maintaining the keep-out area in the PCB 150 design may not occur, and wiring, vias, or electronic devices may be present in the keep-out area.

As shown in FIG. 9, the metal frame 202 of the connector module 200 may be in contact with an electronic device on the PCB 150, for example the via 152. The via 152 is described above and may be electrically connected to a line, another via, and an electronic device on a PCBA, for example, the PCBA 100 as described above.

The connector module 200 may have a compromised or a reduced space 406 between the connector module 200 and the PCB 150. The reduced space 406 does not meet the required standoff clearance between the connector module 200 and the PCB 150. The reduced space 406 may be a result of the connector module 200 not placed properly on the PCB 150 or a manufacturing defect within the connector module 200 or the PCB 150. Alternatively, the connector module 200 may move to a lower position after placement, during a process such as a wave solder process, or other handling of the PCB 150.

The via 152 is part of the electronic circuitry of the PCB 150, thus the electrical contact may result in a short circuit between wiring on the PCB 150 and the connector module 200. The short circuit may result in an unintended electrical connection between an electronic device and circuitry, such as a line, a via, or a solderable surface mount pad, on a resulting PCBA 100, causing failure of either the PCB 150 or the PCBA 100. In this example, the short circuit may be caused by the via 152 being placed within the footprint of the connector module 200, and by the reduced space 406. An electrical circuit on the PCBA 100 may have an unintended short across the metal frame 202, unintentionally connecting two electrical features of the PCBA 100.

As shown in FIG. 10, the connector module 200 may be improperly mounted on the PCB 150. Specifically, one edge or corner of the connector module 200 may be tilted down toward the PCB 150. This tilt may cause the unintended reduction of a space 410, between the connector module and the PCB 150, resulting in an electrical contact between the connector module 200 and lines, an electronic device, or a via, for example the via 152, on the PCB 150. The connector module 200 may be tilted as a result of the connector module 200 not placed properly on the PCB 150. Alternatively, the connector module 200 may become tilted after placement during a process such as a wave solder process, or other handling of the PCB 150.

The space 410 does not meet the required standoff clearance between the connector module 200 and the PCB 150. The short circuit between the via 152, or other lines on the PCB 150, and the connector module 200 may result in an unintended electrical connection between an electronic device and circuitry, such as a line, a via, or a solderable surface mount pad, on a resulting PCBA 100, causing failure of either the PCB 150, or the PCBA 100.

Figure 11:
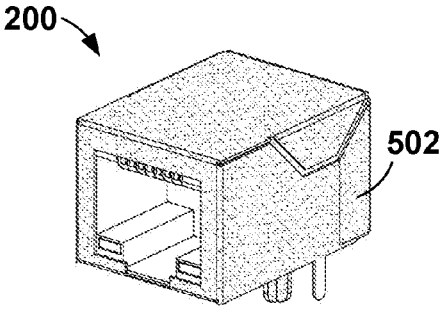
FIGS. 11, 12, 13, 14, 15, 16, 17, and 18, each illustrate an isometric view of a single port connector module, according to an embodiment.
Figure 12:
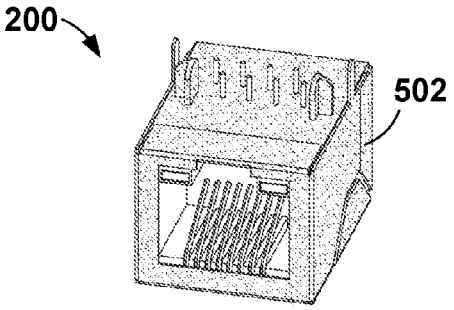

Referring now to FIGS. 11 and 12, an isometric view of the connector module 200 is shown, according to an embodiment. The connector module 200 is as described above. As shown in FIG. 11, the isometric view of the connector module 200 illustrates a front, a top and a first side of the connector module 200. As shown in FIG. 12, the isometric view of the connector module 200 illustrates the front, a bottom and a second side of the connector module 200. In this embodiment, a metal frame 202, as described above, of the connector module 200 overlaps a portion of a bottom, or a portion of a housing as described above, of the connector module 200. In an alternative embodiment, the metal frame 202 of the connector module 200 may also cover the bottom of the connector module 200. In this embodiment, an insulation material 502 covers the metal frame and an exposed portion of a bottom of the housing of the connector module 200.

The insulation material 502 may isolate the metal frame from a printed circuit board, for example the PCB 150, when the connector module 200 has unintended physical contact with the printed circuit board. Examples of unintended physical contact between the connector module 200 and the printed circuit board are described above with respect to FIGS. 9 and 10. The insulation material 502 may not cover a set of metal pins and a grounding pin, both of the connector module 200, as described above. The insulation material 502 may comprise a coating capable of being flexible during metal forming. The insulation material 502 may have good adhesive properties to metal, for example the metal frame, and to plastic, for example, a connector module housing, which creates an isolation layer between the connector module 200 and the PCB 150. The connector module housing may be substantially similar as the housing 206, described above. The insulation material 502 may withstand a temperature and exposure to a wave solder without loss of properties. The connector module may be exposed to a wave solder, for example, when mounted on a printed circuit board assembly, for example, the PCBA 100. The insulation material 502 may include polytetrafluoroethylene (PTFE), polyethylene terephthalate (PET), or polyethylene naphthalate (PEN). In an example, a maximum temperature during the wave solder may be 270 Celsius. An example of properties to be maintained during the wave solder may include adherence to metal, adherence to plastic, and electrical insulation.

Figure 13:
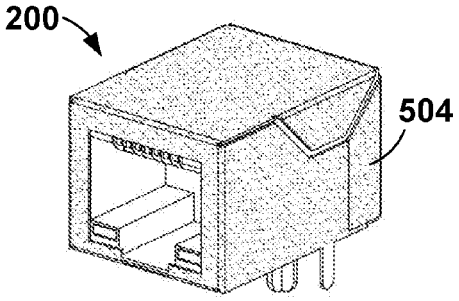
Figure 14:
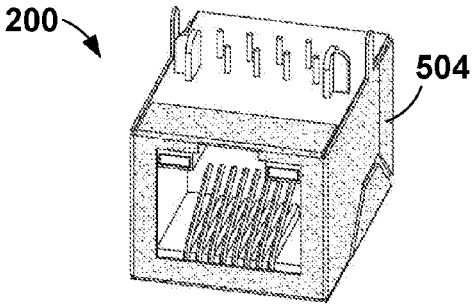

Referring now to FIGS. 13 and 14 an isometric view of the connector module 200 is show, according to an embodiment. The connector module 200 is described above. As shown in FIG. 13, the isometric view of the connector module 200 illustrates a front, a top and a first side of the connector module 200. As shown in FIG. 14, the isometric view of the connector module 200 illustrates the front, a bottom and a second side of the connector module 200. In this embodiment, a metal frame 202, as described above, of the connector module 200 overlaps a portion of the bottom of the connector module 200. In this embodiment, an insulation material 504 covers the metal frame and does not cover an exposed portion of a housing, as described above, on the bottom side of the connector module 200. In an alternative embodiment, the metal housing of the connector module 200 may also cover the bottom, or the housing, of the connector module 200, and the insulation material 504 on the metal frame would be continuous on the bottom of the connector module 200.

The insulation material 504 may be substantially similar as the insulation material 502, described above. The insulation material 504 may create a layer of electronic isolation, or electrical insulation, protecting electronic devices of the PCB 150 from an inadvertent electrical connection to wiring, vias or an electronic device from a short circuit along the metal frame of the connector module 200. The insulation material 504 may not cover a set of metal pins and a grounding pin, both of the connector module 200, as described above.

Figure 15:
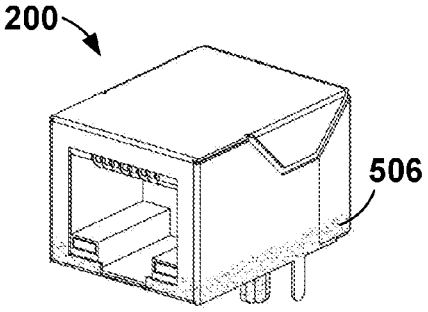
Figure 16:
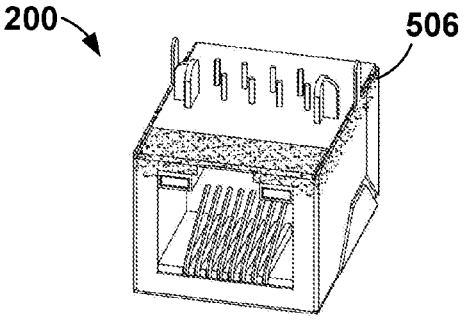

Referring now to FIGS. 15 and 16 an isometric view of the connector module 200 is show, according to an embodiment. The connector module 200 is described above. As shown in FIG. 15, the isometric view of the connector module 200 illustrates a front, a top and a first side of the connector module 200. As shown in FIG. 16, the isometric view of the connector module 200 illustrates the front, a bottom and a second side of the connector module 200. In an alternative embodiment, a metal frame, as described above, of the connector module 200 may also cover the bottom of the connector module 200. In this embodiment an insulation material 506 covers a portion of the bottom of the connector module 200, partially covers the first side, partially covers the second side, partially covers the front, and partially covers a back of the connector module 200. In summary, the insulation material 506 may cover a bottom portion of the metal frame of the connector module 200. The insulation material 506 may not cover a set of metal pins, nor a grounding pin, of the connector module 200. The set of metal pins and the grounding pin of the connector module are as described above.

The insulation material 506 may be substantially similar as the insulation material 502, 504, described above. The insulation material 506 may create a layer of electronic isolation protecting the metal frame of the connector module 200 from an inadvertent electrical connection to wiring, vias or an electronic device on a printed circuit board assembly, for example, the PCBA 100.

Figure 17:
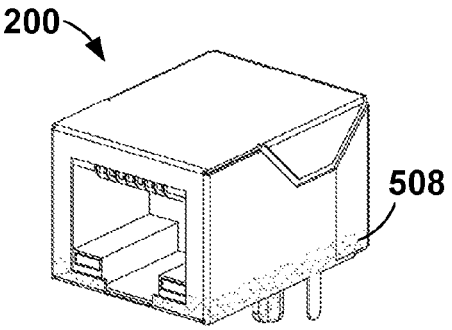
Figure 18:
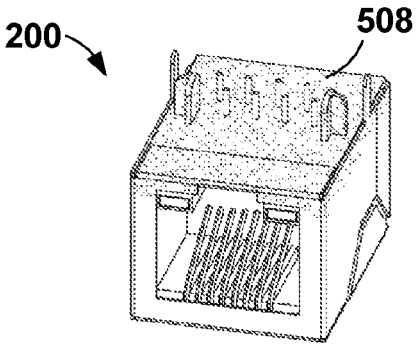

Referring now to FIGS. 17 and 18 an isometric view of the connector module 200 is show, according to an embodiment. The connector module 200 is described above. As shown in FIG. 17, the isometric view of the connector module 200 illustrates a front, a top and a first side of the connector module 200. As shown in FIG. 18, the isometric view of the connector module 200 illustrates the front, a bottom and a second side of the connector module 200. In an alternative embodiment, a metal frame, as described above, of the connector module 200 may also cover a bottom of the connector module 200. In this embodiment an insulation material 508 covers the bottom of the connector module 200, partially covers the first side, partially covers the second side, partially covers the front, and partially covers the back of the connector module 200. In summary, the insulation material 508 may cover a bottom portion of the connector module 200. The insulation material 508 may not cover a set of metal pins, nor a grounding pin, of the connector module 200. The set of metal pins and the grounding pin of the connector module are as described above.

The insulation material 508 may be substantially similar as the insulation material 502, 504, 506, described above. The insulation material 508 may create a layer of electronic isolation protecting the metal frame of the connector module 200 from an inadvertent electrical connection to wiring, vias or an electronic device on a printed circuit board assembly, for example, the PCBA 100.

Figure 19:
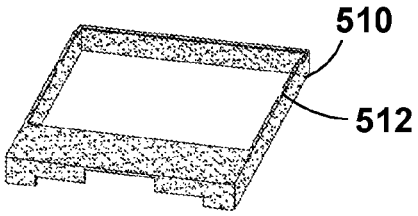
FIGS. 19 and 20 each illustrate an isometric view of an insulator jacket, according to an embodiment.

Referring now to FIG. 19, an isometric view of an insulator jacket 510 is show, according to an embodiment. The isometric view of the insulator jacket 510 illustrates a front, a bottom, and a first side of the insulator jacket 510. The insulator jacket 510 may be fitted to slide over the connection module 200, as described above. The insulator jacket may adhere to the connection module 200. A material may be used between the insulator jacket 510 and the connector module 200 to improve adhesion between the insulator jacket 510 and the connector module 200. As shown in FIG. 19, the insulator jacket 510 may be sized to cover a portion of a metal frame, as described above, of the connector module 200. The insulator jacket 510 may have an opening 512 which may align with a grounding pin of the connector module 200, allowing a grounding pin of the connector module 200, as described above, to extend through the insulator jacket 510.

In an embodiment, the insulator jacket 510 may partially cover the connector module 200. The insulator jacket 510 may partially cover a bottom, partially cover a first side, partially cover a second side, partially cover a front, and partially cover a back of the connector module 200. In summary, the insulator jacket 510 may cover a bottom portion of the connector module 200. The insulator jacket 510 may not cover a set of metal pins, nor a grounding pin, of the connector module 200.

The insulator jacket 510 may be substantially similar as the insulation material 502, 504, 506, 508, described above. The insulator jacket 510 may create a layer of electronic isolation protecting the metal frame of the connector module 200 from an inadvertent electrical connection to wiring, vias or an electronic device on a printed circuit board assembly, for example, the PCBA 100. The insulator jacket 510 may be pre-formed and may be added to the connector module 200 after assembly of the connector module 200.

Figure 20:
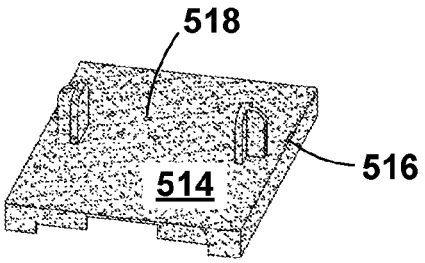

Referring now to FIG. 20, an isometric view of an insulator jacket 514 is show, according to an embodiment. The isometric view of the insulator jacket 514 illustrates a front, a bottom, and a first side of the insulator jacket 514. The insulator jacket 514 may be fitted to slide over the connection module 200, as described above, and adhere to the connection module 200. As shown in FIG. 20, the insulator jacket 514 may be sized to cover a portion of a metal frame, as described above, of the connector module 200. The insulator jacket 514 may have an opening 516 which may align with a grounding pin of the connection module 200, allowing a grounding pin of the connector module 200, as described above to extend through the insulator jacket 514. The insulator jacket 514 may have an opening 518. The opening 518 may be a set of holes which correspond to a set of metal pins, as described above, of the connector module 200.

In an embodiment, the insulator jacket 514 may partially cover the connector module 200. The insulator jacket 514 may cover a bottom, partially cover a first side, partially cover a second side, partially cover a front, and partially cover a back of the connector module 200. In summary, the insulator jacket 510 may cover a bottom portion of the connector module 200. The insulator jacket 510 may not cover a set of metal pins, nor a grounding pin, of the connector module 200. The insulator jacket 514 may be pre-formed and may be added to the connector module 200 after assembly of the connector module 200.

The insulator jacket 514 may be substantially similar as the insulation material 502, 504, 506, 508, 510, 512 described above. The insulator jacket 514 may create a layer of electronic isolation protecting the metal frame of the connector module 200 from an inadvertent electrical connection to wiring, vias or an electronic device on a printed circuit board assembly, for example, the PCBA 100.

Figure 21:
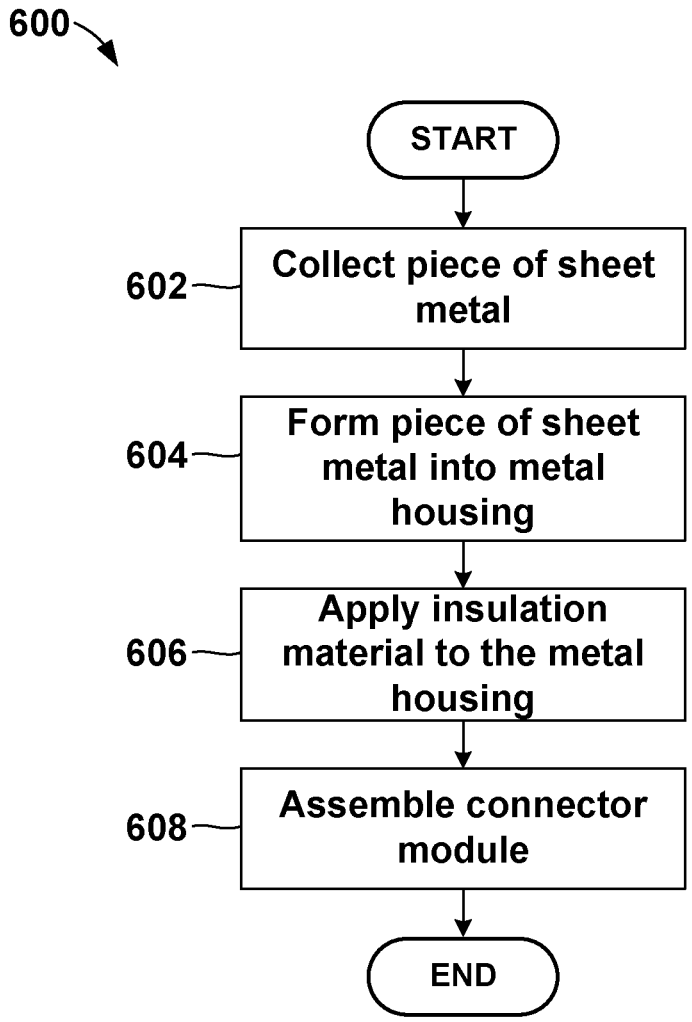
FIG. 21 illustrates an insulation process, according to an embodiment.

Referring now to FIG. 21, an insulation process 600 is shown, according to an embodiment.

At step 602, collect a piece of sheet metal. The piece of sheet metal may comprise materials such as aluminum, steel, iron, and other material commonly used for shielding electronic devices. The piece of sheet metal may have a ferrite coating.

At step 604, form the piece of sheet metal into a metal frame. The metal frame may be substantially similar as the metal frame 202, described above in regards to the connector module 200.

At step 606, apply an insulation material to the metal frame. The insulation material may be substantially similar as the insulation material 502, 504, 506, 508, and the insulation material of FIGS. 19 and 20 as described above.

At step 608, assemble the metal frame into a connector module. The connector module may be substantially similar as the connector module 200 as described above.

The insulation material may comprise a coating capable of being flexible during metal forming. The insulation material may have good adhesive properties to metal, for example the metal frame, and to plastic, for example, a connector module housing. The connector module housing may be substantially similar as the housing 206, described above. The insulation material may withstand a temperature and exposure to a wave solder without loss of properties. The connector module may be exposed to a wave solder, for example, when mounted on a printed circuit board assembly, for example, the PCBA 100. The insulation material may include polytetrafluoroethylene (PTFE), polyethylene terephthalate (PET), or polyethylene naphthalate (PEN).

The insulation material may help protect against metal whiskers. The insulation material may prevent metal whiskers from causing short circuits between electronic devices, wiring, and vias on the PCBA and the connector module.

In an alternate embodiment, the steps described above may be performed in an alternate sequence. Application of an insulation material may be applied to a piece of sheet metal. The piece of sheet metal may then be formed into a metal frame. Next, a connector module may be assembled using the metal frame.

In an additional alternate embodiment of an alternate sequence, a piece of sheet metal may be collected. Then, the piece of sheet metal may be formed into metal frame. Next, the metal frame may be used in the assembly of a connector module. Then, the insulation material may be applied to the connector module. The insulation material may be applied to a portion of the connector module. A set of metal pins of the connector module may not be covered with the insulation material. The set of metal pins of the connector module may be substantially similar as the set of metal pins 214 described above, and may be used to electrically connect the connector module to a PCB, upon which the connector module is mounted.

Figure 22:
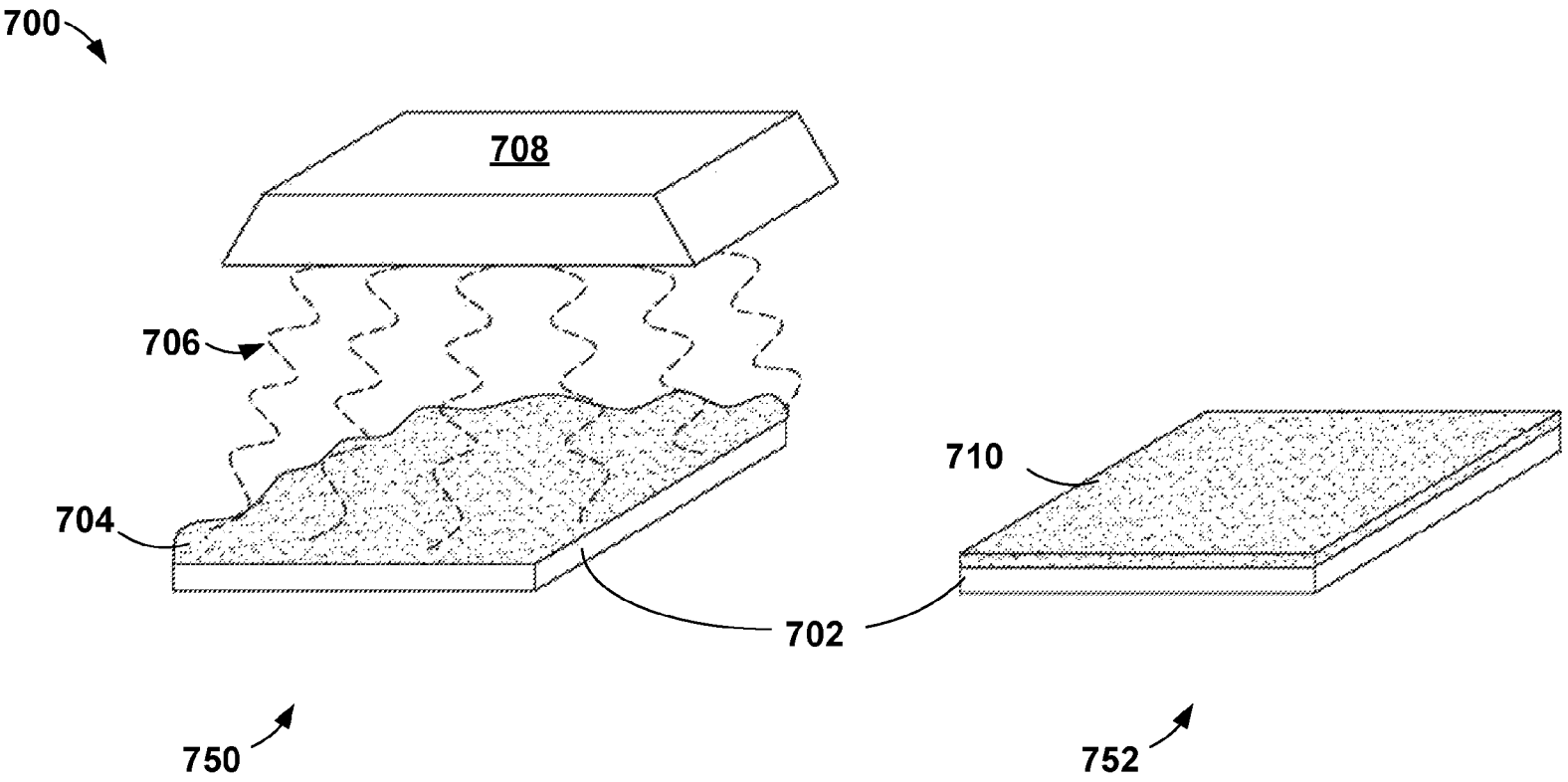
FIG. 22 illustrates a coating process on a piece of sheet metal, according to an embodiment.

Referring now to FIG. 22, a powder coating process 700 on a piece of sheet metal is shown, according to an embodiment. The powder coating process 700 may be used to apply an insulation material to a piece of sheet metal used for forming a metal frame of a connector module. The insulation material may be substantially similar to the insulation material 502, 504, 506, 508, and the insulation material of FIGS. 19 and 20, all as described above.

As shown in FIG. 22, a piece of sheet metal 702, powder 704, heat 706, a heat source 708, and an insulation material 710, are shown.

At step 750, electrostatic spraying of the powder 704 onto the piece of sheet metal may occur. The powder 704 may be powdered particles or atomized liquid. During electrostatic spraying 706, the powder 704 is electrically charged. The piece of sheet metal 702 may be connected to ground. The powder 704 may be projected to the piece of sheet metal 702, and an electrostatic charge 706 between the powder 704 and the piece of sheet metal 702 helps adhesion and efficient coverage of the powder 704 to the piece of sheet metal 702.

At step 752, curing of the piece of sheet metal 702 with the powder 704, may occur. Curing may include an elevated temperature resulting in the powder 704 to melt, flow out and then chemically react to form the insulation material 710 with desirable characteristics as described above. The desirable characteristics include a coating capable of being flexible during metal forming, good adhesive properties to metal, and able withstand a temperature and exposure to a wave solder without loss of properties.

The piece of sheet metal 702 with the insulation material 710 may next be formed into a metal frame, as described above in relation to FIG. 21. The metal frame may then be assembled into a connector module, as described above.

In an alternate embodiment, a piece of sheet metal may be formed into a metal frame, the metal frame substantially similar to the metal frame 202 described above. Next the metal frame may be powder coated, as described above. The metal frame may then be assembled into a connector module, as described above.

An additional alternate embodiment to apply insulation material to the piece of sheet metal, may include a dip coating into the insulation material. Dip coating includes an immersion into the insulation material and removal from the immersion. A layer of the insulation material remains deposited on a surface. The piece of sheet metal may then be formed into a metal frame, as described above. The formed metal frame may then be assembled into a connector module, as described above. The dip coating may be performed on a portion of the piece of sheet metal, or the entire piece of sheet metal may be dip coated except for the grounding pins.

A further embodiment may include a dip coating, as described above, of a formed metal frame, described above. The dip coated formed metal frame may then be assembled into a connector module, as described above. The dip coating may be performed on a portion of the formed metal frame, or the entire formed metal frame may be dip coated except for the grounding pins.

A further embodiment may include a dip coating, as described above, of a connector module, described above. A barrier may be on a portion of the connector module to prevent adhesion of the dip coating to the portion of the connector module. For example, a set of metal pins of the connector module and the grounding pins of the metal frame may be protected by a barrier such that the insulation material does not adhere to the set of metal pins nor the grounding pins. The set of metal pins may be substantially similar as the set of metal pins 214 and the grounding pins may be substantially similar as the grounding pins 220 described above, and may be used to electrically connect the connector module to a PCB, upon which the connector module is mounted. The dip coating may be applied to a portion of the connector module.

The insulation material may be used on electronic devices with a grounded metal body to prevent a short circuit between electronic devices, and may improve an integrity and quality of the electronic devices. The insulation material may be a coating on a metal frame of a connector module to help avoid a short circuit between electronic devices, and wiring of a PCB, upon which the connector module is mounted. The insulation material may cover a connector module or may cover a portion of the connector module.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method for electrically insulating a connector module mounted on a printed circuit board assembly, the method comprising:

coating a first portion of a piece of sheet metal with an insulation material, wherein coating the piece of sheet metal with an insulation material comprises electrostatically spraying the piece of sheet metal with electrically charged powder, while the piece of sheet metal is connected to ground, and curing the electrostatically sprayed piece of sheet metal, wherein the insulation material comprises polytetrafluoroethylene, and characteristics of the insulation material comprise flexibility during metal forming, adherence to metal, and an ability to withstand a temperature of a wave solder and an exposure to the wave solder;

forming the piece of sheet metal into a metal frame, wherein the metal frame overlaps a portion of a bottom of the connector module, and wherein a second portion of the piece of sheet metal not coated with the insulation material is formed into a grounding pin of the metal frame;

assembling the connector module, wherein components of the connector module comprise the metal frame, a housing, a set of external pins, and two or more sockets, wherein the two or more sockets each comprise an opening which accepts a corresponding connector, and wherein a first socket of the two or more sockets accepts an Ethernet connector; and mounting the connector module on a printed circuit board to form a printed circuit board assembly, wherein the set of external pins are electrically connected to a corresponding set of vias on the printed circuit board, and the grounding pin is electrically connected to a ground on the printed circuit board, and a space remains between the connector module and the printed circuit board.

* * * * *